US005961235A

United States Patent [19]

Kennedy

[11] Patent Number: 5,961,235

[45] Date of Patent: Oct. 5, 1999

[54] LOTION APPLICATOR WITH HANDLE RESERVOIR

[76] Inventor: Patricia T. Kennedy, 1400 Bristol Road West Unit #20, Mississauga, Ontario, Canada, L5V 2A4

[21] Appl. No.: 09/035,378

[22] Filed: Mar. 5, 1998

[51] Int. Cl.[6] ..... A45D 40/26

[52] U.S. Cl. ..... 401/6; 401/140; 601/68

[58] Field of Search ..... 401/6, 140; 601/17, 601/18, 65, 67, 68

[56] References Cited

U.S. PATENT DOCUMENTS

| | | | |
|---|---|---|---|
| 2,282,700 | 5/1942 | Bobbroff | 601/68 |
| 3,138,813 | 6/1964 | Kaplan | 601/68 |
| 4,078,865 | 3/1978 | Moser | 401/140 |
| 4,858,600 | 8/1989 | Gross et al. | 401/28 |
| 5,823,206 | 10/1998 | Mapleback | 401/6 |

*Primary Examiner*—Charles R. Eloshway

[57] ABSTRACT

A lotion applicator is provided including a handle with a mounting plate coupled to an inboard end thereof. A sponge is in turn mounted on the plate. A lotion dispensing assembly includes a cylindrical reservoir formed in an outboard end of the handle. The handle has a cap coupled to the outboard end thereof for allowing access to the reservoir. The lotion assembly further includes a conduit formed in concentric relationship with the handle and in communication between the reservoir and the sponge.

2 Claims, 2 Drawing Sheets

LOTION APPLICATOR WITH HANDLE RESERVOIR

BACKGROUND OF THE INVENTION

1. Field of the Invention

The present invention relates to lotion applicators and more particularly pertains to a new lotion applicator with handle reservoir for applying lotion to a body of a user.

2. Description of the Prior Art

The use of lotion applicators is known in the prior art. More specifically, lotion applicators heretofore devised and utilized are known to consist basically of familiar, expected and obvious structural configurations, notwithstanding the myriad of designs encompassed by the crowded prior art which have been developed for the fulfillment of countless objectives and requirements.

Known prior art lotion applicators include U.S. Pat. No. 5,341,538; U.S. Pat. No. 5,240,339; U.S. Pat. No. 5,054,504; U.S. Pat. No. 4,934,011; and U.S. Pat. Des. No. 333,191.

In these respects, the lotion applicator with handle reservoir according to the present invention substantially departs from the conventional concepts and designs of the prior art, and in so doing provides an apparatus primarily developed for the purpose of applying lotion to a body of a user.

SUMMARY OF THE INVENTION

In view of the foregoing disadvantages inherent in the known types of lotion applicators now present in the prior art, the present invention provides a new lotion applicator with handle reservoir construction wherein the same can be utilized for applying lotion to a body of a user.

The general purpose of the present invention, which will be described subsequently in greater detail, is to provide a new lotion applicator with handle reservoir apparatus and method which has many of the advantages of the lotion applicators mentioned heretofore and many novel features that result in a new lotion applicator with handle reservoir which is not anticipated, rendered obvious, suggested, or even implied by any of the prior art lotion applicators, either alone or in any combination thereof.

To attain this, the present invention generally comprises a handle having a circular cross-section with a common shape and size along an entire length thereof. As shown in FIG. 1, the handle has a linear inboard extent with a first length. Associated therewith is a linear outboard extent with the first length. An arcuate intermediate extent is formed between the extents such that the inboard and outboard extents reside about parallel offset axes. Next provided is a mounting plate having a square planar configuration. The mounting plate has a top face integrally coupled to an inboard end of the inboard extent. A plane in which the mounting plate resides is situated in parallel offset relationship with the axis associated with the inboard extent of the handle. Mounted to a bottom face of the mounting plate is a square permeable sponge. A periphery of the sponge has a size similar to that of the mounting plate and depth which is at least 4 times that of the mounting plate. FIG. 3 shows a lotion dispensing assembly including a cylindrical reservoir formed in an outboard end of the outboard extent of the handle. For allowing access to the reservoir, the handle has a cap screwably coupled to the outboard end of the outboard extent. The lotion assembly further includes a conduit formed in concentric relationship with the handle and in communication between the reservoir and the sponge. Finally, a vibration mechanism is provided including a motor mounted within the inboard end of the inboard extent of the handle. An eccentric weight is mounted on the motor for vibrating the mounting plate and sponge upon the actuation thereof. A battery is mounted within a top surface of the intermediate extent of the handle. Connected between the motor and the battery is a push button momentary switch mounted to a top surface of the outboard extent of the handle just inward of the reservoir. The switch is adapted for actuating the motor upon the depression thereof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lotion applicator with handle reservoir apparatus and method which has many of the advantages of the lotion applicators mentioned heretofore and many novel features that result in a new lotion applicator with handle reservoir which is not anticipated, rendered obvious, suggested, or even implied by any of the prior art lotion applicators, either alone or in any combination thereof.

It is another object of the present invention to provide a new lotion applicator with handle reservoir which may be easily and efficiently manufactured and marketed.

It is a further object of the present invention to provide a new lotion applicator with handle reservoir which is of a durable and reliable construction.

An even further object of the present invention is to provide a new lotion applicator with handle reservoir which is susceptible of a low cost of manufacture with regard to both materials and labor, and which accordingly is then susceptible of low prices of sale to the consuming public, thereby making such lotion applicator with handle reservoir economically available to the buying public.

Still yet another object of the present invention is to provide a new lotion applicator with handle reservoir which provides in the apparatuses and methods of the prior art some of the advantages thereof, while simultaneously overcoming some of the disadvantages normally associated therewith.

Still another object of the present invention is to provide a new lotion applicator with handle reservoir for applying lotion to a body of a user.

Even still another object of the present invention is to provide a new lotion applicator that includes a handle with a mounting plate coupled to an inboard end thereof. A sponge is in turn mounted on the plate. A lotion dispensing assembly includes a cylindrical reservoir formed in an outboard end of the handle. The handle has a cap coupled to the outboard end thereof for allowing access to the reservoir. The lotion assembly further includes a conduit formed in concentric relationship with the handle and in communication between the reservoir and the sponge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
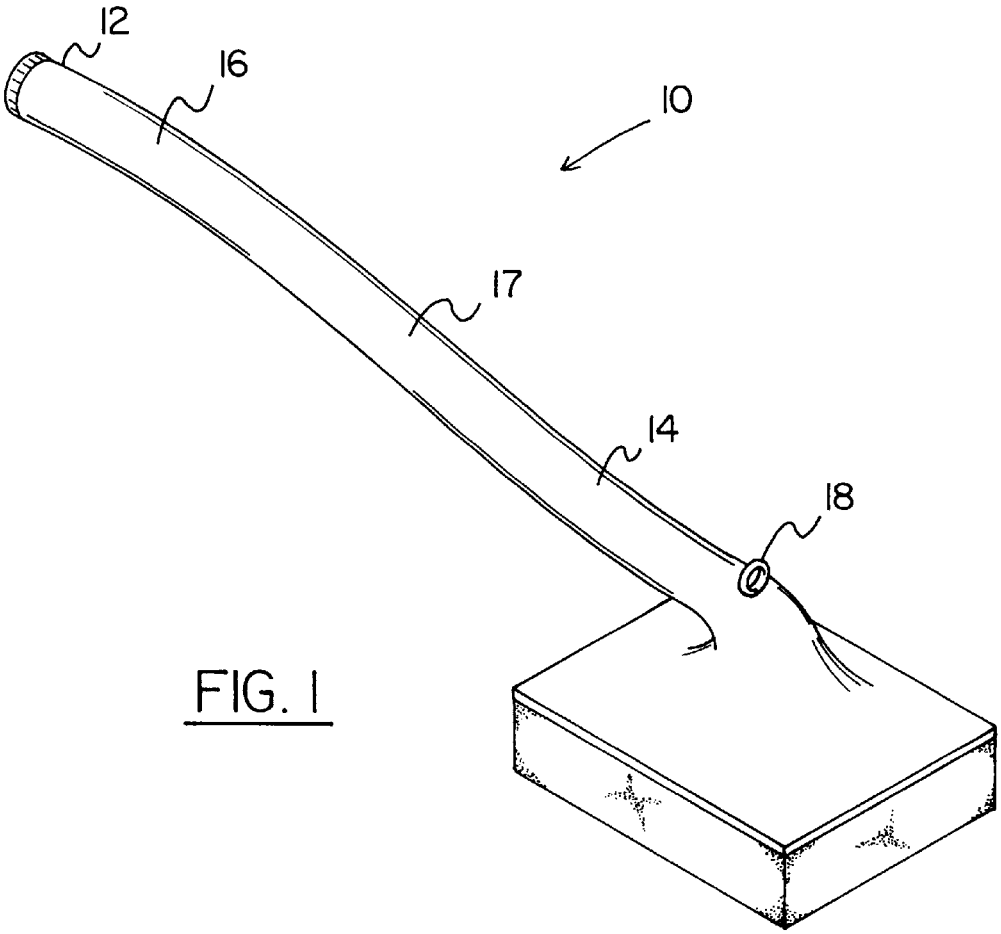
FIG. 1 is a perspective view of a new lotion applicator with handle reservoir according to the present invention.
Figure 2:
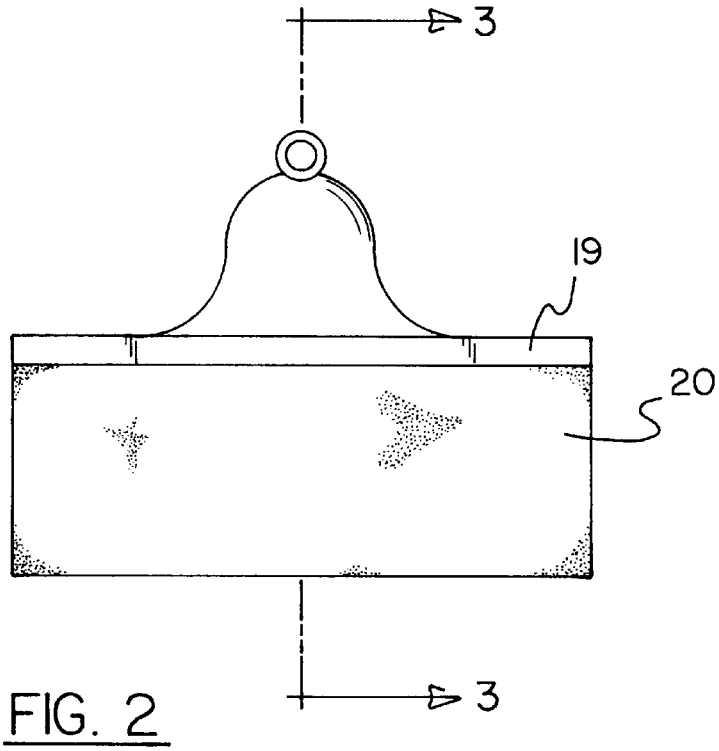
FIG. 2 is an end view of the present invention.

With reference now to the drawings, and in particular to FIGS. 1 through 4 thereof, a new lotion applicator with handle reservoir embodying the principles and concepts of the present invention and generally designated by the reference numeral 10 will be described.

The present invention, designated as numeral 10, includes a handle 12 having a circular cross-section with a common shape and size along an entire length thereof. As shown in FIG. 1, the handle has linear inboard extent 13 with a first length defined between portions 14 and 33. Associated therewith is a linear outboard extend 15 also with a first length defined between portions 16 and 34. An arcuate intermediate extent 17 is formed between the extents such that the inboard and outboard extents reside about parallel offset axes 35,36.

Figure 3:
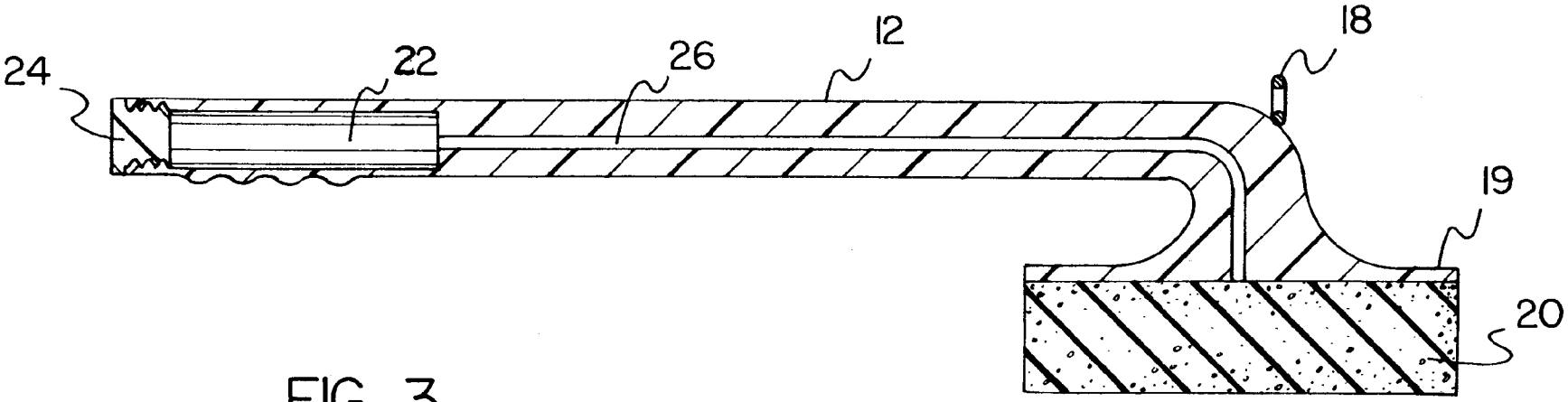
FIG. 3 is a side cross-sectional view of the present invention.
Figure 4:
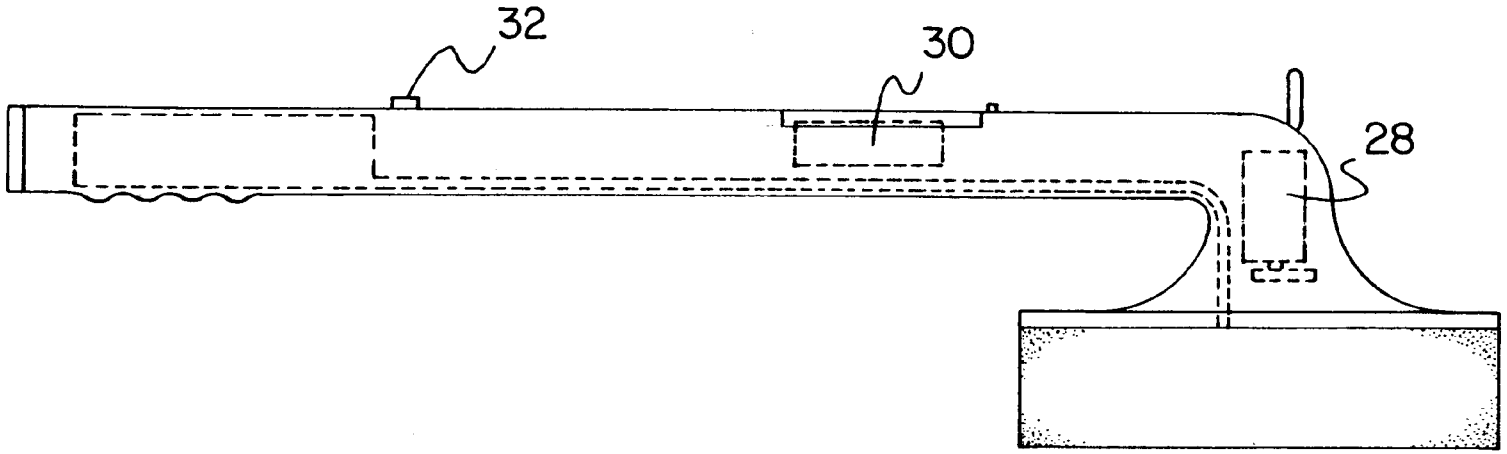
FIG. 4 is a side view of an alternate embodiment of the present invention.

In the preferred embodiment, a bottom surface of the outboard extent of the handle has a plurality of undulations formed therein for gripping purposes, as shown in FIG. 3. Further, a rigid O-ring 18 is integrally coupled to a top surface of the inboard end of the inboard extent for allowing the present invention to be conveniently The O-ring is ideally situated about an axis situated in parallel with the handle.

Next provided is a mounting plate 19 having a square planar configuration. The mounting plate has a top face integrally coupled at a center thereof to an inboard end of the inboard extent. By such coupling, a plane in which the mounting plate resides is situated in parallel offset relationship with the axis associated with the inboard extent of the handle. Mounted to a bottom face of the mounting plate is a square permeable sponge 20. A periphery of the sponge has a size similar to that of the mounting plate and depth which is at least 4 times that of the mounting plate.

FIG. 3 shows a lotion dispensing assembly including a cylindrical reservoir 22 formed in an outboard end of the outboard extent of the handle. The reservoir preferably has a length approximately ⅓ that of the handle. For allowing access to the reservoir, the handle has a cap 24 screwably coupled to the outboard end of the outboard extent. The lotion assembly further includes a conduit 26 formed in concentric relationship with the handle and in communication between the reservoir and the sponge. It should be noted that a diameter of the conduit is less than ⅓ that of the reservoir.

By this structure, lotion may be situated within the reservoir and dispensed through the sponge when the present invention is inverted. To further facilitate dispensing, a portion of the handle which encompasses the reservoir is thin so as to allow the compression thereof.

Finally, an optional vibration mechanism 28 is provided including a motor mounted within the inboard end of the inboard extent of the handle. An eccentric weight is mounted on the motor for vibrating the mounting plate and sponge upon the actuation thereof. A battery 30 is mounted within a top surface of the intermediate extent of the handle.

Connected between the motor and the battery is a push button momentary switch 32 mounted to a top surface of the outboard extent of the handle just inward of the reservoir. The switch is adapted for actuating the motor upon the depression thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to he encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lotion applicator comprising, in combination:

a handle having a circular cross-section with a generally constant shape and size along an entire length thereof, the handle having a linear inboard extent with a first length, a linear outboard extent with the first length and an arcuate intermediate extent formed therebetween such that the inboard and outboard extents reside about parallel offset axes for permitting a wider range of pivoting of the handle towards and away from a user when applying lotion;

a bottom surface of the outboard extent of the handle having a plurality of undulations formed therein for gripping purposes;

a rigid O-ring being integrally coupled to a top surface of an inboard end of the inboard extent adapted for permitting hanging of the handle;

wherein the O-ring is situated about an axis situated in parallel with the handle;

a mounting plate having a square planar configuration, the mounting plate having a top face integrally coupled to an inboard end of the inboard extent such that a plane in which the mounting plate resides is situated in a parallel offset relationship with the axis associated with the inboard extent of the handle, wherein the plate has a square permeable sponge mounted to a bottom face thereof, the sponge having a size similar to that of the mounting plate;

a lotion dispensing assembly including a cylindrical reservoir formed in an outboard end of the outboard extent of the handle, wherein the handle has a cap screwably coupled to the outboard end of the outboard extent for allowing access to the reservoir, the lotion assembly further including a conduit formed in the handle and in communication between the reservoir and the sponge;

wherein an inner diameter of the conduit is less than about ⅓ an inner diameter of the reservoir;

wherein a portion of the handle encompassing the reservoir is resiliently deformable so as to allow compression thereof to facilitate dispensing; and a vibration mechanism including a motor mounted within the inboard end of the inboard extent of the handle with an eccentric weight mounted thereon for vibrating the mounting plate and sponge upon the actuation thereof, a battery mounted within a top surface of the intermediate extent of the handle and a push button momentary switch mounted to a top surface of the outboard extent of the handle just inward of the reservoir, the switch connected between the motor and the battery for actuating the motor upon the depression thereof.

2. A lotion applicator comprising, in combination:

a handle having a circular cross-section with a generally constant shape and size along an entire length thereof, the handle having a linear inboard extent with a first length, a linear outboard extent with the first length and an arcuate intermediate extent formed therebetween such that the inboard and outboard extents reside about parallel offset axes for permitting a wider range of pivoting of the handle towards and away from a user when applying lotion;

a bottom surface of the outboard extent of the handle having a plurality of undulations formed therein for gripping purposes;

a rigid O-ring being integrally coupled to a top surface of an inboard end of the inboard extent adapted for permitting hanging of the handle;

a mounting plate having a top face integrally coupled to an inboard end of the inboard extent such that a plane in which the mounting plate resides is situated in a parallel offset relationship with the axis associated with the inboard extent of the handle, wherein the plate has a permeable sponge mounted to a bottom face thereof, the sponge having a size similar to that of the mounting plate;

a lotion dispensing assembly including a cylindrical reservoir formed in an outboard end of the outboard extent of the handle, wherein the handle has a cap screwably coupled to the outboard end of the outboard extent for allowing access to the reservoir, the lotion assembly further including a conduit formed in the handle and in communication between the reservoir and the sponge, wherein a portion of the handle encompassing the reservoir is resiliently deformable so as to allow compression thereof to facilitate dispensing; and a vibration mechanism including a motor mounted within the inboard end of the inboard extent of the handle with an eccentric weight mounted thereon for vibrating the mounting plate and sponge upon the actuation thereof, a battery mounted within a top surface of the intermediate extent of the handle and a push button momentary switch mounted to a top surface of the outboard extent of the handle just inward of the reservoir, the switch connected between the motor and the battery for actuating the motor upon the depression thereof.

* * * * *